US011592264B1

(12) United States Patent
Ding et al.

(10) Patent No.: US 11,592,264 B1
(45) Date of Patent: Feb. 28, 2023

(54) FIREARM STOCK MOUNT ASSEMBLY

(71) Applicant: Leapers, Inc., Livonia, MI (US)

(72) Inventors: Tai-lai Ding, Northville, MI (US); Tat Shing Yu, Plymouth, MI (US)

(73) Assignee: Leapers, Inc., Livonia, MI (US)

( * ) Notice: Subject to any disclaimer, the term of this patent is extended or adjusted under 35 U.S.C. 154(b) by 62 days.

(21) Appl. No.: 17/478,106

(22) Filed: Sep. 17, 2021

(51) Int. Cl.
*F41C 23/04* (2006.01)
*F41C 23/20* (2006.01)

(52) U.S. Cl.
CPC ..... *F41C 23/20* (2013.01); *F41C 23/04* (2013.01)

(58) Field of Classification Search
CPC ..... F41C 23/04; F41C 23/14; F41C 23/20; F41C 27/06; F41A 3/84; F41A 11/02; F41A 3/66; F41A 11/04; F41A 19/10; F41A 3/26; F41A 35/06
USPC ..... 42/71.01, 73, 1.06, 72, 74, 71.02, 42/75.01–75.1; 89/191.01, 193, 198
See application file for complete search history.

(56) References Cited

U.S. PATENT DOCUMENTS

| | | | | |
|---|---|---|---|---|
| 4,769,938 | A * | 9/1988 | Chesnut | F41A 21/02 42/76.02 |
| 9,228,795 | B1 | 1/2016 | Kielsmeier | |
| 9,488,434 | B2 | 11/2016 | Kielsmeier | |
| 9,739,565 | B2 | 8/2017 | Kielsmeier | |
| 10,551,143 | B2 | 2/2020 | Kielsmeier | |
| 2012/0137561 | A1* | 6/2012 | Ludlow | F41C 23/04 42/75.03 |
| 2015/0113848 | A1* | 4/2015 | Monveldt | F41A 35/06 42/16 |
| 2015/0316347 | A1* | 11/2015 | Shea | F41C 23/16 42/75.02 |

* cited by examiner

*Primary Examiner* — Michael D David
(74) *Attorney, Agent, or Firm* — Warner Norcross + Judd LLP

(57) ABSTRACT

A stock mount assembly, which mounts a stock to a weapon, can include a base block including a longitudinal axis separating a first side and an opposing second side; a first lateral wedge opposing a second lateral wedge; a locking block slidably engaging the first lateral wedge and the second lateral wedge at a plurality of facets angled relative to one another; and a fastener aligned with the longitudinal axis. Rotation of the fastener can displace the locking block relative to the base block to urge the first lateral wedge and the second lateral wedge away from one another to forcibly engage first and second side surfaces of a cavity within the firearm to secure a stock to the firearm with the assembly. A related method of use is provided.

20 Claims, 8 Drawing Sheets

FIREARM STOCK MOUNT ASSEMBLY

BACKGROUND OF THE INVENTION

The present invention relates to firearms, and more particularly to an assembly to mount a stock to a firearm.

Many modern sporting and military firearms include a stock that extends rearward from the firearm. The stock typically includes a forward portion that connects to a receiver of the firearm, and a rearward portion that is shaped and distanced from the receiver of the firearm so that a user can engage the rearward portion against the user's shoulder and stabilize the firearm. Some stocks are adjustable in length to accommodate individuals of different statures. Other stocks are foldable so that a user can fold the stock forward alongside or over the receiver so that the firearm is more compact and/or maneuverable.

Firearms frequently are produced and sold to consumers by manufacturers with standard stocks which are constructed from wood or low grade plastic. For some firearms, these standard stocks also are non-folding and/or not adjustable in length. Accordingly, an aftermarket for specialty stocks has developed to provide aesthetically pleasing, folding and/or adjustable stocks of higher quality or enhanced function over the standard, original stocks. Consumers typically will purchase such aftermarket stocks and install them on their firearm themselves, or hire a gunsmith to do so.

Typically, aftermarket stocks come with one or more interfaces that allow the user to remove the original stock from a firearm and join the new stock to the firearm in its place. The interface secures the new stock on the firearm, typically with a screw. An issue arises, however, when the firearm is of a type made by multiple manufacturers that have a wide range of manufacturing tolerances. For example, AK-47 type firearms have been made and sold across the globe for over seventy years by a variety of manufacturers. Although manufacturers attempt to adhere to a common pattern and design, multiple sets of manufacturing tolerances exist, particularly from country to country of the manufacturer, and over the many years of manufacture. As a result of these differences, the interface for an aftermarket stock may fit one firearm from one manufacturer, but not another firearm from another manufacturer. Sometimes, the interface may fit one firearm tightly and well, but might fit another with a lot of slop and play. As a result, the interface might produce movement between the stock and the firearm, which can compromise shooting form and accuracy of the firearm. In some cases, the interface might fail completely, resulting in the stock being separated from the firearm, and perhaps damaged and/or lost.

Accordingly, there remains room for improvement in the field of firearm stock mount assemblies.

SUMMARY OF THE INVENTION

A stock mount assembly that mounts a stock to a weapon is provided. The assembly can include a base that joins with a stock, a base block, opposing first and second lateral wedges, a locking block located between and engaging the first and second lateral wedges, and a fastener. When the fastener is moved, it displaces the locking block relative to the base block to urge the first lateral wedge and the second lateral wedge away from one another to forcibly engage first and second side surfaces of a cavity within the firearm to secure a stock to the firearm with the assembly.

In one embodiment, the locking block can includes a multi-facet engagement end that faces toward the locking block. The multi-facet engagement end can slidably engage multiple corresponding facets of the first lateral wedge and the second lateral wedge. As the locking block wedges between the first lateral wedge and the second lateral wedge, those wedges can expand outward and laterally, away from one another, to engage with force sides of the cavity in which they are positioned.

In another embodiment, the locking block can include a first wedge ridge and a second wedge ridge on a first side and a second side of the longitudinal axis. The first and second wedge ridges can be symmetrically opposed across the axis. These wedge ridges can engage corresponding facets of the first and second lateral wedges to push the wedges away from one another or generally into engagement with sides of a cavity of the firearm.

In still another embodiment, the first lateral wedge and the second lateral wedge can be biased toward the longitudinal axis with a first biasing element. The first bias element can be an elastomeric or flexible tension element or ring that extends between the first lateral wedge and the second lateral wedge. The tension element can extend around parts of the first lateral wedge and the second lateral wedge and can urge the first lateral wedge and the second lateral wedge toward one another. With this tension element, the lateral wedges can be secured to and engage consistently the locking block.

In yet another embodiment, the locking block can be biased away from the base block with a second bias element separate from the first bias element. The second bias element can be a coil spring aligned with the longitudinal axis and surrounding the fastener. The coil spring can be disposed between the base block and the locking block, urging the locking block to move away from the base block when the fastener is loosened.

In a further embodiment, the mount assembly can include a first threaded insert joined with the locking block and configured to engage the fastener, and a second threaded insert joined with the base block and configured to engage the fastener distal from the first threaded insert. The inserts can prevent wear and tear on the locking block and base block so that they can be constructed from a softer material than the fastener.

In still a further embodiment, the base can include a compartment. The base block can be slidably secured in the compartment to fit a particular tolerance of a cavity of a weapon in which the mount assembly is to be installed.

In still yet a further embodiment, the stock mount assembly and the lateral wedges can be operable in a retracted mode and an extended mode. In the retracted mode, the first and second lateral wedges can be flush with or only a small distance from sidewalls of the base block. In the extended mode, the first and second lateral wedges can be moved or pushed outward, away from one another and/or the longitudinal axis, in a lateral manner. In so doing, the wedges can move a larger distance from the sidewalls of the base block, or otherwise protrude farther laterally outward from the longitudinal axis or other components of the mount assembly.

In another further embodiment, a method of using the mount assembly is provided. The method can include rotating a fastener relative to base block and a locking block disposed between and engaging a first lateral wedge and a second lateral wedge oppositely disposed from one another on a first side and a second side of a longitudinal axis; and displacing the locking block relative to the base block to transversely extend the first lateral wedge and the second lateral wedge away from the longitudinal axis and/or away from one another. As a result, the wedges can forcibly engage first and second side surfaces of a cavity within a firearm to secure the stock to the firearm with the assembly.

The current embodiments of the stock mount assembly and related method provide benefits in quickly and efficiently mounting a stock to a variety of weapons having varying tolerances and dimensions at a stock attachment location. In some cases, the locking block and lateral wedges can expand primarily laterally, rather than vertically, to snugly engage an interior cavity of the weapon, for example, a compartment of a receiver of the weapon. Further, the lateral wedges can directly engage sidewalls or surfaces of the cavity, which sometimes are stronger and sturdier than other vertical elements of the firearm. Where a biasing element is included around parts of the lateral wedges, it can automatically urge those wedges toward the axis to a retracted mode. Where another biasing element urges the locking block away from the base block, that locking block can move under the force of the other biasing element as the biasing element around parts of the lateral wedges move the wedges back toward the axis to the extended mode. The stock mount assembly can provide a secure and easily installed construction that firmly and consistently mounts a stock to a weapon.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
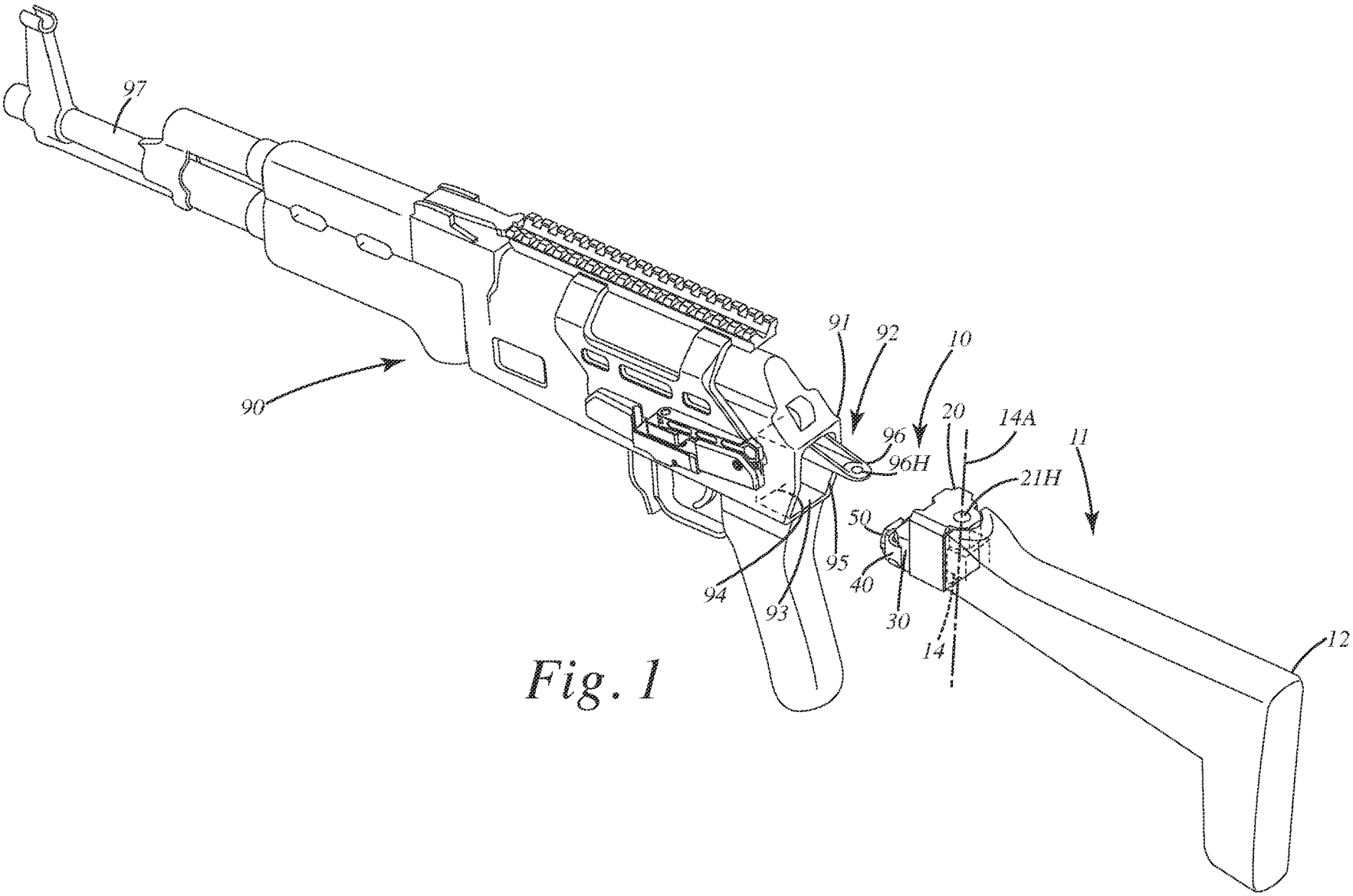
FIG. 1 is a side view of a stock with a stock mount assembly of a current embodiment, shown before mounting the stock to the weapon.

A current embodiment of the stock assembly is illustrated in FIGS. 1-7 and generally designated 10. The stock mount assembly 10 is configured to secure a stock 11 to a receiver or frame 91 associated with a weapon 90, such as a firearm or other projectile shooting device. In some cases, the weapon can be a sporting, military or hunting rifle, for example an AK47, an AR15, variants thereof and other firearm systems. More generally, the weapon can be in the form of a firearm, including, but not limited to a handgun, for example, a pistol and/or a revolver; a rifle, for example, a long rifle, a carbine, an assault rifle, a bolt pump rifle or a battle rifle; a shotgun of any gauge; and/or a machine gun, for example, a machine pistol, a light machine gun, a mini gun, a medium machine gun or a heavy machine gun. The firearm can include any type of action, for example, bolt action, lever action, pump action and/or break action. The firearm can be single shot, automatic and/or semiautomatic. Further optionally, the firearm can be in the form of a vehicle-mounted weapon, mounted directly to the vehicle, a watercraft or other mode of transportation of course. As used herein, firearm also can include cannons, howitzers, hand-held rocket launchers and similar weaponry, as well as equipment such as paint ball markers and air rifles such as bb guns, air soft guns and/or pellet guns. The weapon also can be in the form of a bow, such as a crossbow or other archery bow with a handle and/or stock.

Figure 2:
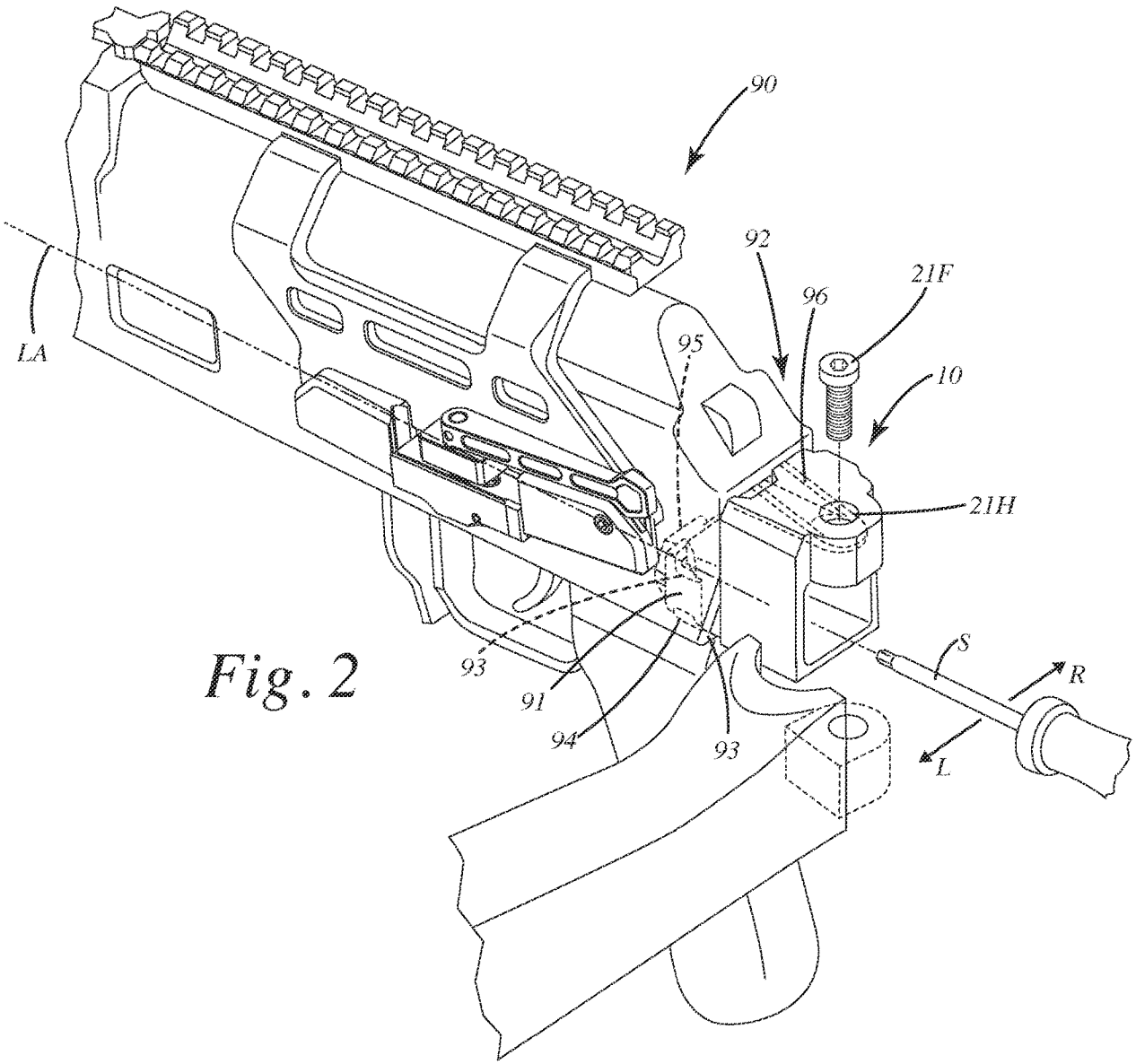
FIG. 2 is a second side view of the stock with the stock mount assembly initially installed in a receiver of the firearm.

The stock mount assembly 10 in FIGS. 1 and 2 is configured to be joined with a rearward part 92 of a weapon 90, which can be the form of an AK47 as shown, or other weapons as mentioned above. The stock mount assembly 10 can be configured to fit within a cavity or compartment 93 in the rearward portion of the receiver or frame 91, and support the stock 11 in a direction opposite a barrel 97 of the weapon. The stock mount assembly 10 can be joined with the rearward part 92 of the weapon at a first end of the stock, which can be opposite a second end of the stock, optionally including a butt portion or shoulder engagement element 12. Optionally, the stock mount assembly 10 can include a folding joint 14 with a pivot axis 14A. The folding joint 14 can allow the butt portion 12 to fold about the pivot axis 14A, generally making the illustrated stock assembly a folding stock. Of course, where the joint is not included, the stock can be a fixed, non-folding stock assembly.

Turning now to FIGS. 2-7, the stock mount assembly 10 and its components will now be described. As shown in FIGS. 1-2, the stock mount assembly 10 can be configured to join the remainder of the stock 11 with the receiver 91 of the weapon 90. The receiver 91 can include a cavity or compartment 93 that is defined by opposing side walls 94 and 95. The sidewalls can have side surfaces that form left and right sides of the cavity 93. The stock mount assembly 10 optionally also can interface with a rear stock tab 96 that comes standard with many types of firearms designs, such as an AK47 firearm design. Of course, the stock mount assembly 10 can be modified where the weapon does not include such a rear stock tab 96.

Figure 6:
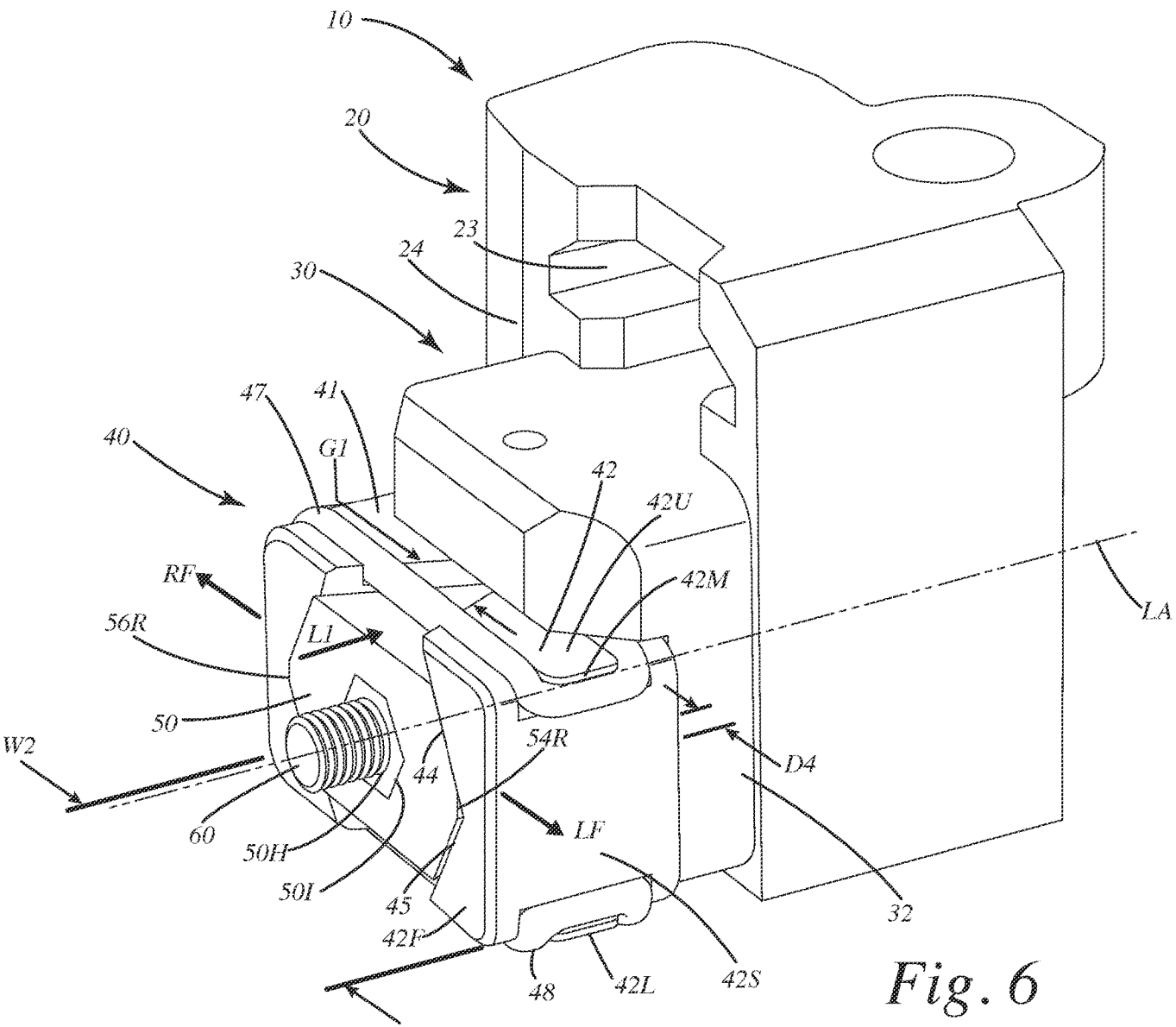
FIG. 6 is a side perspective view of the stock mount assembly in an expanded mode.

The stock mount assembly 10 can be configured to exert outward lateral forces LF and RF as shown in FIG. 6 against the left and right side walls 94, 95 of the cavity 93 of the receiver or frame 91. This lateral expansion, rather than a vertical expansion, has been surprisingly and unexpectedly found to fit more types and variants of the AK47. Sometimes, pins and support bars can interfere with any type of vertical expansion of the stock mount assembly 10, which is why the lateral expansion is used in the current embodiments herein.

Figure 3:
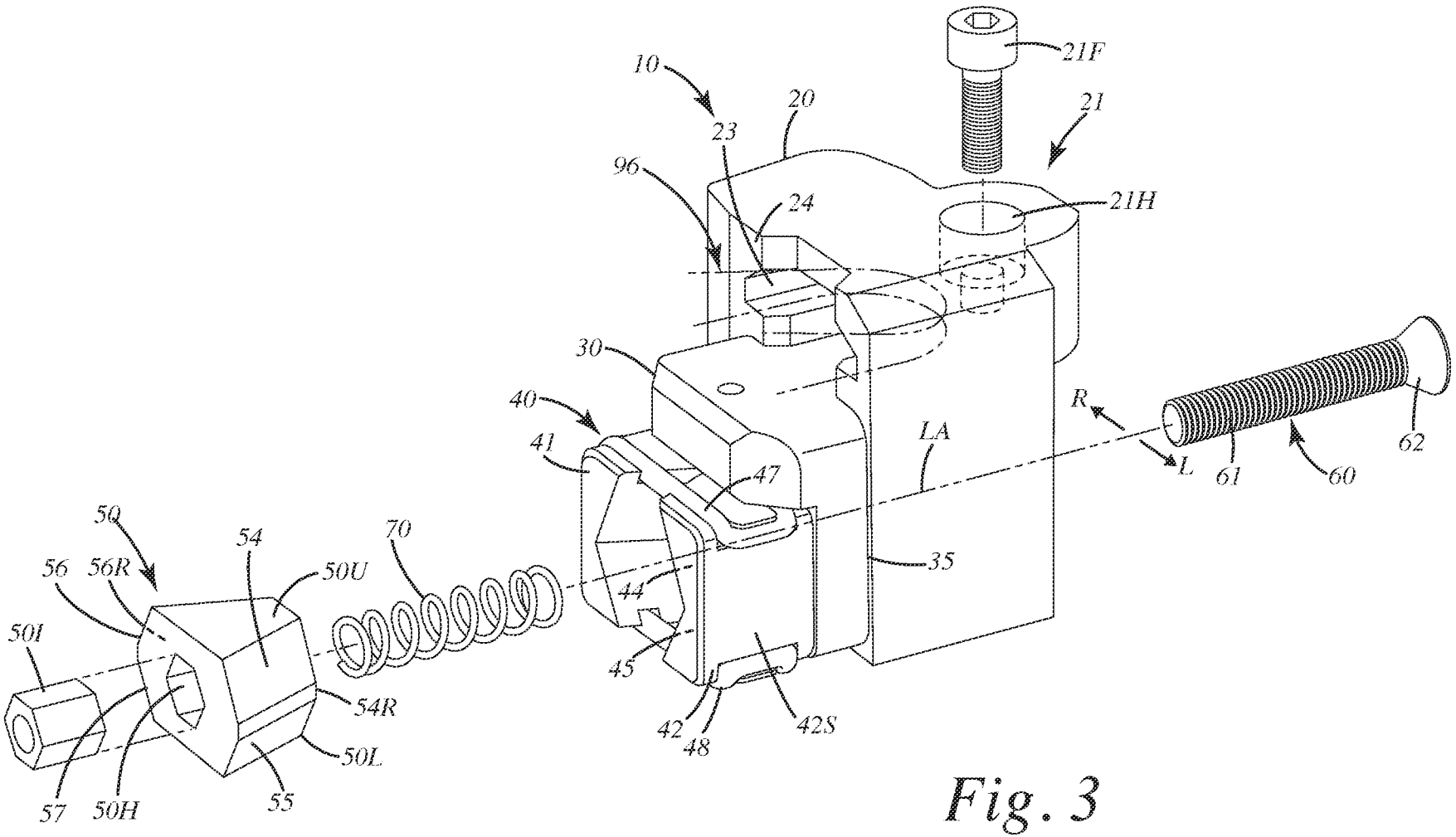
FIG. 3 is a side perspective exploded view of the stock mount assembly.
Figure 4:
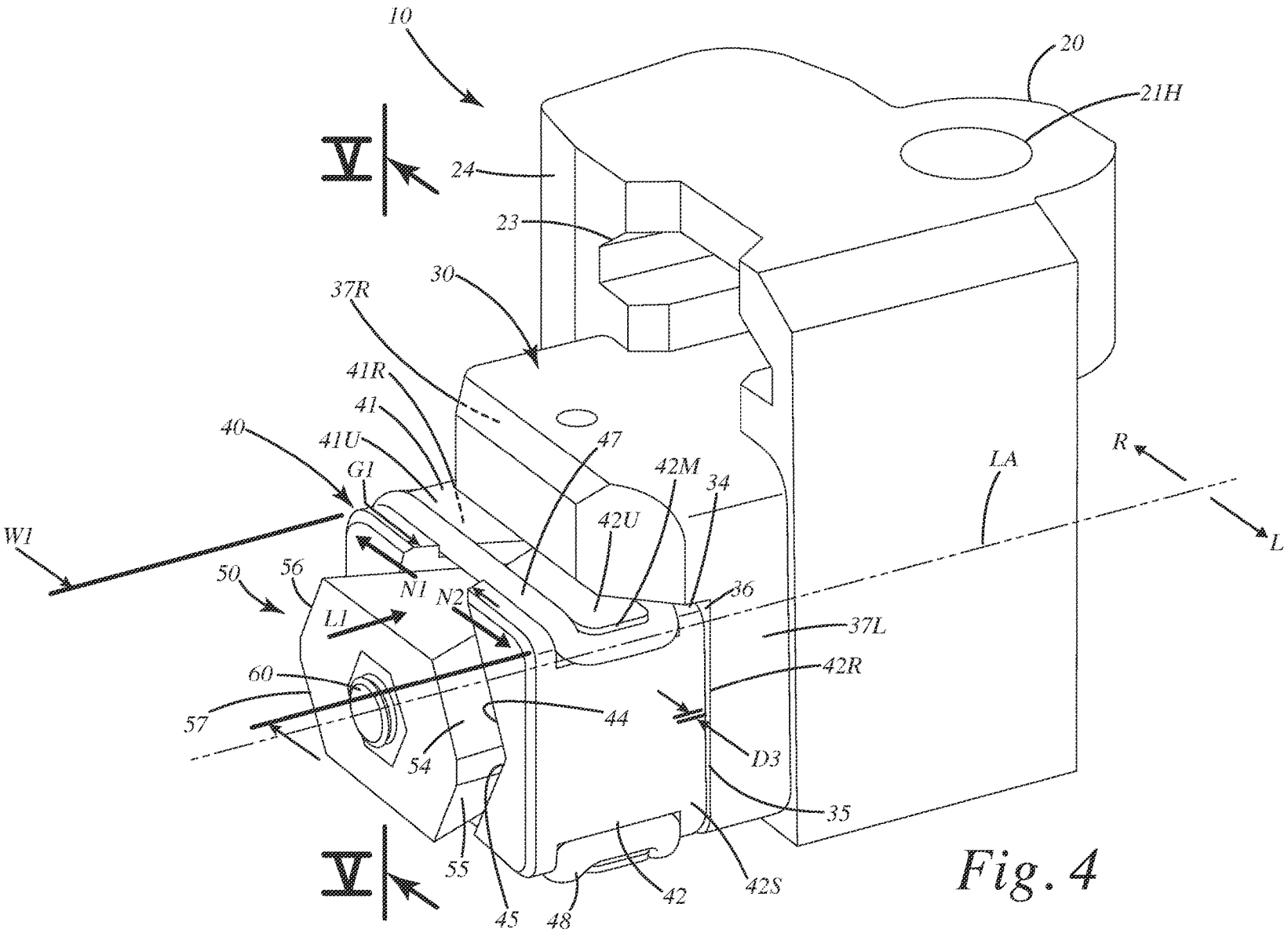
FIG. 4 is a side perspective view of the stock mount assembly in an unexpanded mode.

Turning with more particularly to FIGS. 3-4, the stock assembly 10 can include a base 20 including an adapter 21 that can secure to the stock 11 so the stock 11 can protrude rearward from the weapon upon installation of the stock mount assembly 10. This adapter can be a or include a folding joint in some applications, or can be a connector or other element that is joined with the stock 11. The stock mount assembly 10 can further include a base block 30 is joined with the base 20 either integrally and/or as a separate component. A lateral wedge assembly or mechanism 40, including a first lateral wedge 41 and a second lateral wedge 42, can be movably mounted relative to the base block 30. A locking block 50 can be joined with a fastener 60 that projects between the first and second lateral wedges and can be rotatably and operably coupled to the base block. This fastener 60 can move that locking block 50 to operate the first and second lateral wedges 41, 42 to move them laterally, away from one another and/or the longitudinal axis LA of the stock mount assembly 10, depending on whether the stock mount assembly is being can transitioned to or from an extended mode, to forcibly engage the first and second side surfaces or sidewalls 94, 95 of the cavity 93 within the firearm 90 to secure the stock 11 to the firearm with the assembly 10.

Figure 5A:
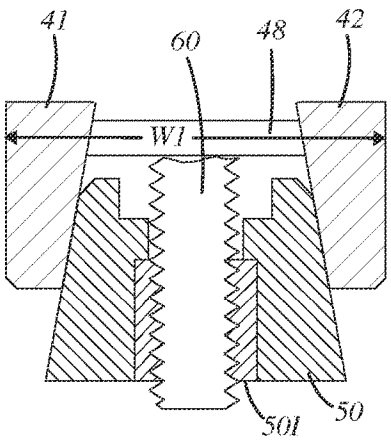
FIG. 5A is a top section view of the locking block engaging the opposing lateral wedges with a biasing element urging the wedges in contact with the locking block in a retracted mode.
Figure 5:
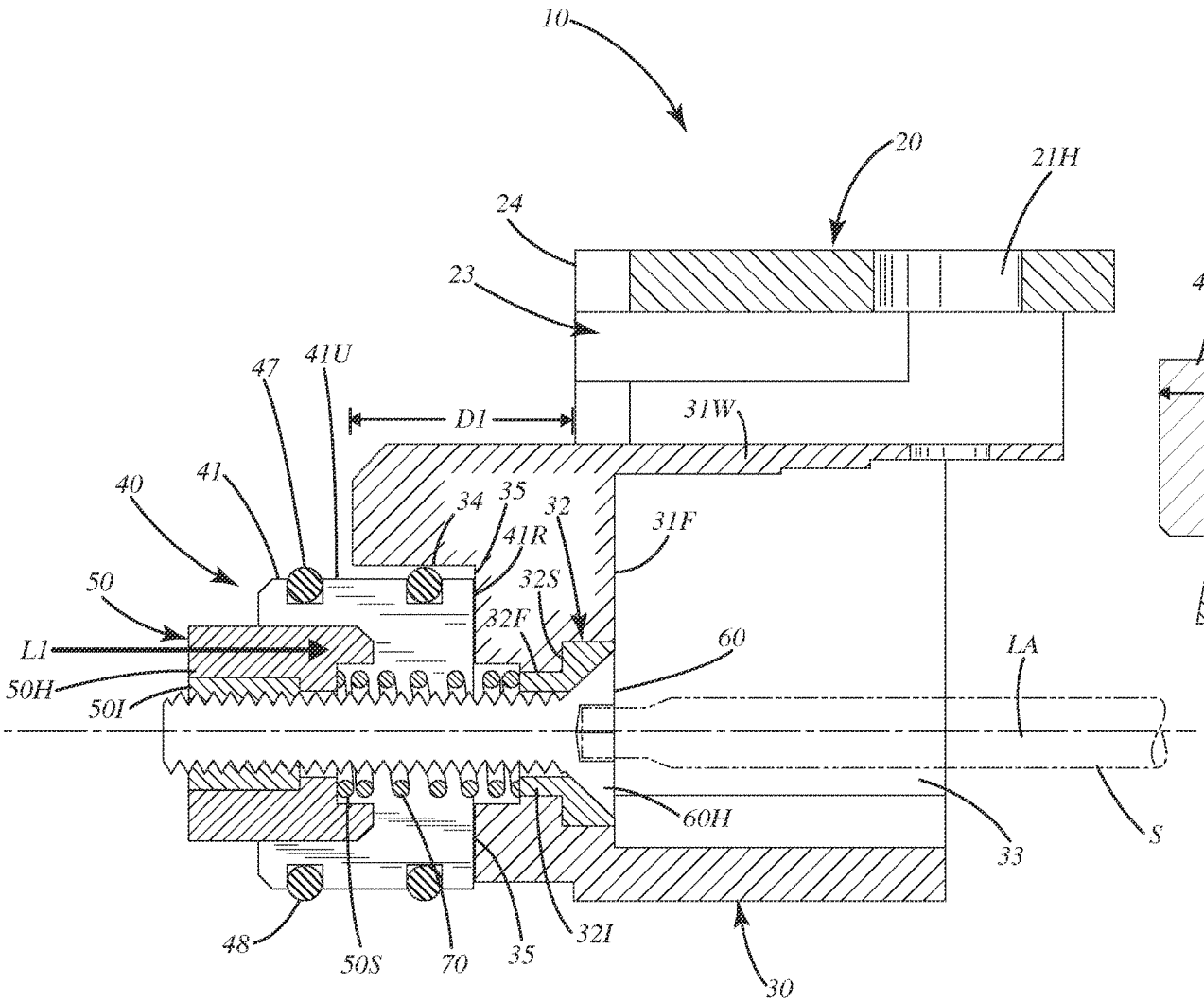
FIG. 5 is a side section view of the stock mount assembly in the unexpanded mode.

Turning first to the base 20, that structure can include an adapter 21. This adapter 21 can be any adapter configured to join the base with a stock 11 as mentioned above. As shown, the adapter 21 can define an aperture 21H. A fastener 21F can be secured into a threaded receiver or other aperture defined by the stock 11. Where the stock 11 is a folding stock, the adapter 21 and fastener 21F can be configured to join to the portion of a joint of the folding stock. Optionally, the base 20 can define a recess or aperture 23 that extends rearwardly from a front face 24 of the base 20 as shown in FIGS. 4 and 5. The recess 23 can be sized and configured to receive a portion or all of the rear stock tab 96. The rear stock tab can fit frictionally within the recess and can add stability to the mounting of the base rearward of the receiver 91. The recess 23 can receive and conceal part or all of the rear stock tab 96 when inserted therein.

Optionally, the base 20 can be configured such that the rear stock tab 96 projects rearward within the recess 23 a sufficient distance so that the hole or aperture 96H defined by the rear stock tab 96 aligns with the hole 21A in the base. In this manner, the fastener 21F sometimes can project through the hole 96H and the rear stock tab to further secure the base to the firearm 90, but in other applications, the fastener might not do so.

As shown in FIGS. 3-5, the base 20 can include the base block 30 projecting optionally forwardly from the front surface 24 of the base 20. This base block as shown can be an integral part of the base. In other constructions, it can be a separate and independently constructed component that is secured with fasteners or other mechanisms to the base 20. The base block can extend along and can include the longitudinal axis LA as shown in FIG. 4. It also can extend to the left side L and right side R of the longitudinal axis LA. The base block 30 can include an axis cavity 33 that extends forwardly from the hole 21H defined by the base 20. The cavity 33 can extend forwardly under an upper wall 31W of the base block to a forward wall 31F. The base block 30 also can extend forwardly from the remainder of the base a distance D1 which can depend on the internal dimensions of the cavity 33 and the rear of the frame or receiver 91 of the firearm 90. When installed fully in the firearm, the front surface 24 of the block 20 can abut a rear surface of the receiver 91 and can conceal the rear stock tab 96.

The front wall 31F of the base block 30 can define an aperture 32 that is configured to receive the fastener 60. The aperture 32 can include a shoulder 32S that is configured to receive a head 60H of the fastener 60. The aperture 32 can include a forward portion 32F that is recessed and includes a shoulder. This forward portion 32 of can be sized to accommodate an insert 32I that is threaded and can receive the fastener 60. In some applications, the body of the base block 30 can be constructed from a softer material than the fastener. For example, the base block 30 can be metal, composite, or polymer such as aluminum, carbon and/or plastic. The insert 32I can be constructed from a harder metal such as steel or iron. The fastener 60 also can be constructed from a harder material that contacts the insert. The insert 32I can be cemented, adhered, sonically welded or otherwise secured in the forward portion 32F of the aperture 32.

The base block 30 can extend forwardly and can include a shelf or overhang 34 that extends forwardly from the base 20. This shelf or overhang 34 can be a flat planar surface that is disposed immediately adjacent the wedge assembly 40. The wedges 41 and 42 of the assembly 40 can ride and slide directly adjacent and relative to the shelf 34. The base block also can include a forward engagement surface 35 through which the fastener projects. That forward engagement surface 35 can surround a portion of the insert 32I and the longitudinal axis LA. The forward engagement surface 35 can directly engage the respective first and second lateral wedges 41 and 42 in use. The shelf 34 and the forward engagement surface 35 optionally can be at right angles relative to one another. The shelf 34 and forward engagement surface 35 can transition to the lateral side surfaces 37L and 37R of the base block 30. The upper surfaces 41U and 42U of the respective first and second lateral wedges can slide along and engage or otherwise be guided by the shelf 34. The rear surfaces 41R and 42R of the respective first and second lateral wedges can move adjacent, slide along otherwise engage the front engagement portion 35 of the base block as they are modified from a retracted mode to an extended mode as described below.

As mentioned above, the wedge assembly 40, including the first 41 and second 42 lateral wedges can be journaled within the recess 36 defined by the shelf 34 and the forward engagement surface 35 of the base block. This recess 36 can extend transversely relative to the longitudinal axis, extending on the right R and left L sides of the longitudinal axis. The first and second lateral wedges 41, 42 can be disposed within the recess and can move relative to it. The first and second lateral wedges can be mirror images of one another so only the second 42 wedge will be described here. As mentioned above, the second lateral wedge 42 can include a rear surface 42R and an upper surface 42U, as well as a front surface 42F and a lower surface 42L. The wedge can further include a side surface 42S. The side surface 42S can move relative to the side surface 32 of the base block 30, for example as shown in FIG. 4, where the wedge assembly 40 in a retracted mode. There, the wedge 42 can establish a distance D3 between the side 42S and side 32. This distance D3 can be negligible, for example 0 mm or less than 0 mm with the side surface 42S flush with or laying closer to the longitudinal axis LA than the side surface 32. When, however, the wedge assembly 40 is expanded, the first 41 and second 42 wedges expand relative to the longitudinal axis such that the distance increases to the distance D4 shown in FIG. 6, where the distance D4 between the sidewall 42S and the sidewall 32 is greater than the distance D3. This distance of expansion when the wedges 41, 42 expand or extend to the extended mode shown in FIG. 6 can be sufficient such that these wedges move outward in directions N1 and N2, respectively, thereby exerting respective forces LF and RF outward against corresponding side surfaces or sidewalls 94 and 95 within the cavity or compartment 93.

When the wedge assembly is expanded, it also can increase in overall width. For example, in the retracted mode shown in FIG. 4, the assembly 40 is of a first width W1, which can be sized and dimensioned to fit easily within the cavity 93 and between sidewalls 94 and 95. When the wedge assembly 40 is extended, the wedges 41 and 42 move away from one another and/or the longitudinal axis to an extended mode. As shown in that extended mode in FIG. 6 the assembly 40 is of a second width W2, which is greater than the width W1. With this change in width, the outer surfaces of the wedges can forcibly engage the sidewalls 94 and 95 as described further below.

The second lateral wedge 42 can be constructed so that it includes one or more facets. These facets shown in FIG. 6A optionally can include a first facet 44 and a second facet 45. The first facet 44 and second facet 45 can be disposed it a first angle A1 relative to one another. This first angle can be an oblique dihedral angle, and the first and second facets can be generally planar. The first wedge 41 can likewise include similar planar facets that are disposed at a second angle relative to one another. That second angle also can be an oblique dihedral angle, which can be equal to the angle first angle A1.

Optionally, in other configurations, the facets 44 and 45 might not be planar, and can be slightly concave, convex, contoured and/or rounded. Further, these facets can include grooves or ridges, depending on the application. These facets 44 and 45 may extend forward and rearward relative to the respective forward surface 42F and rearward surface 42R of the lateral wedge 42. The facets also can extend upward to the upper surface 42U and downward to the lower surface 42L. The facets can be duplicated on the first lateral wedge 41 with the respective facets on each of the first lateral wedge and second lateral wedge being diametrically opposing one another across the longitudinal axis LA, on opposite sides of the locking block 50. The facets 44 and 45 as well as the other facets on the other lateral wedge 41 can mate with and can be slidably engaged along and with respective facets 54 and 55 of the locking block 50 as described further below.

Figure 6A:
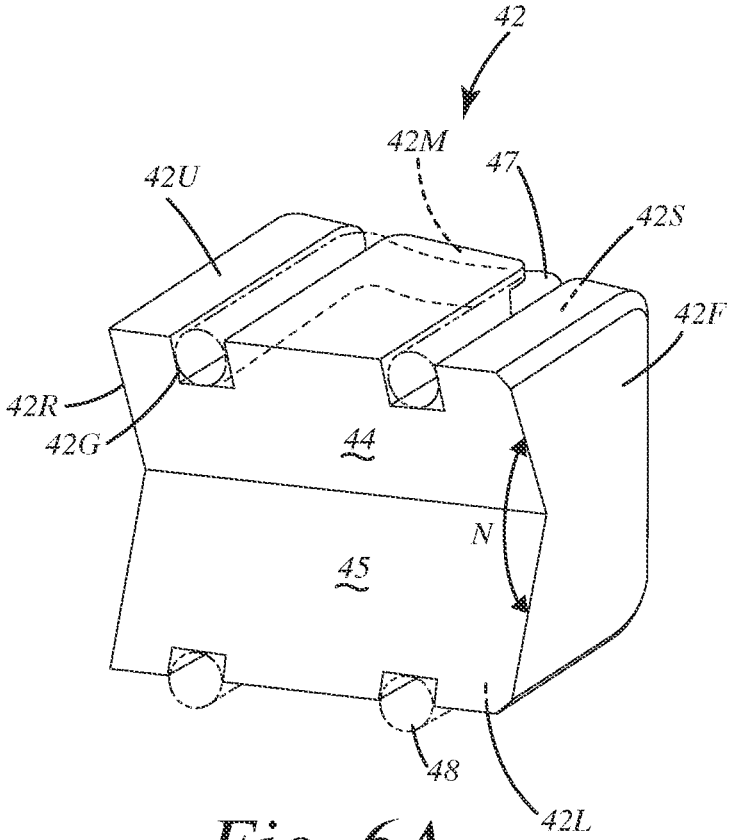
FIG. 6A is a perspective view of a lateral wedge of the stock mount assembly in the expanded mode.
Figure 7A:
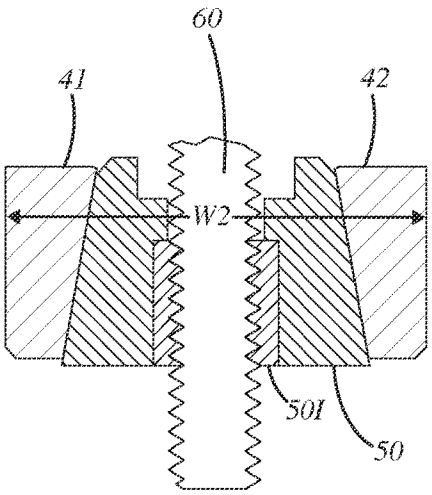
FIG. 7A is a top section view of the locking block engaging the opposing lateral wedges with a biasing element urging the wedges in contact with the locking block in an expanded mode.
Figure 7:
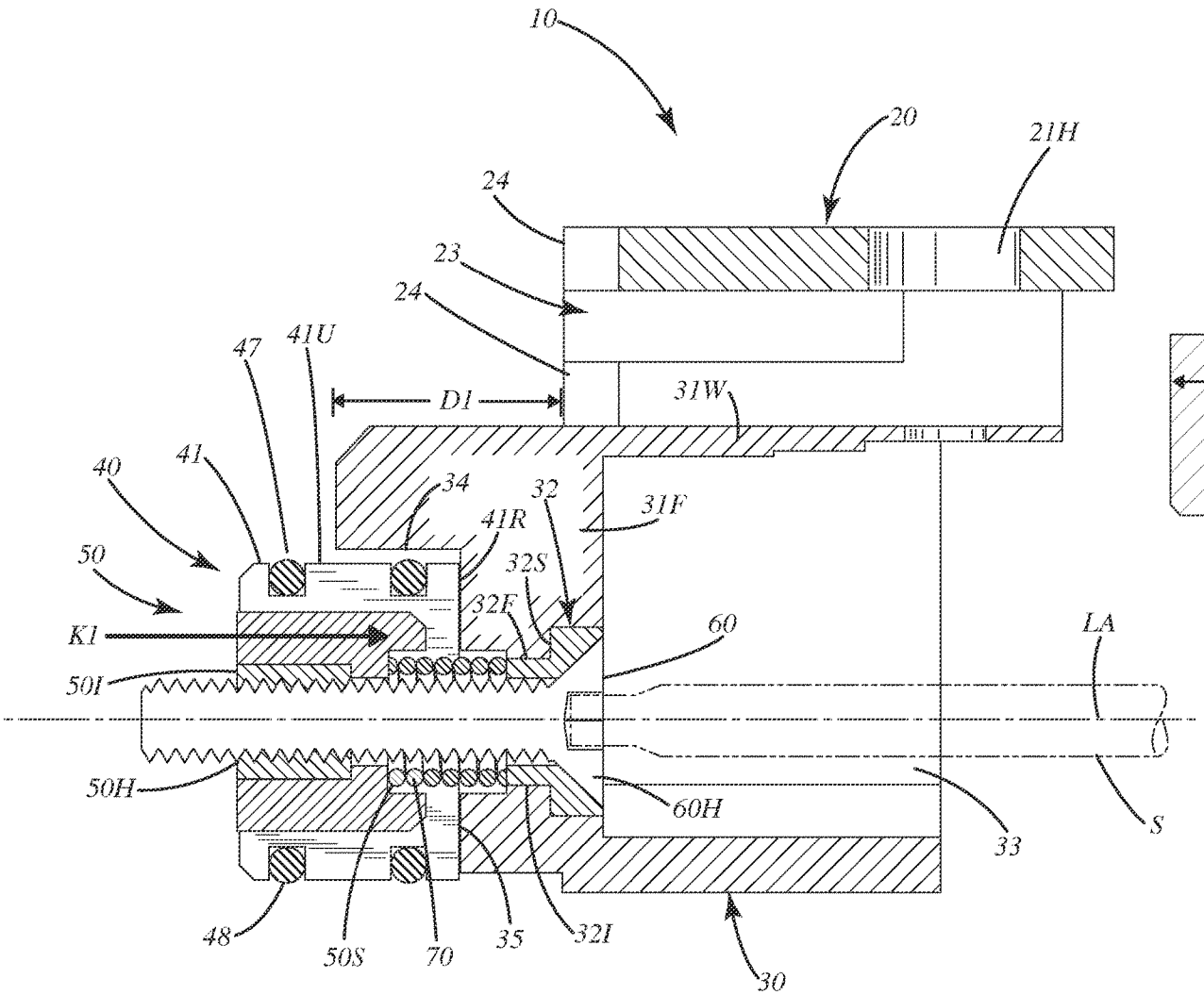
FIG. 7 is a side section view of the stock mount assembly in the expanded mode.

Optionally, the wedge assembly 40, and in particular the first 41 and second 42 wedges, can be biased toward the longitudinal axis LA with a first biasing element 47 a second biasing element 48 which can be disposed above and below the longitudinal axis LA on the respective upper surfaces and lower surfaces of the first and second 41 and 42 lateral wedges. As shown in FIG. 4, the first and second biasing elements can be in the form of elastomeric rings or other elastomeric, stretchable or tension elements, which can extend between the first lateral wedge and the second lateral wedge. For example, the first biasing element 47, which can be disposed on the upper surfaces of the wedges and virtually identical to the second biasing element 48, can extend across a gap G1 between the first 41 and second 42 lateral wedges. This gap G1 can increase in width as it extends away from the base block 30. The first elastomeric ring or tension element 47 can extend within a groove 42G of the second lateral wedge 42 as shown in FIG. 6A. The groove 42G can be defined by the upper surface 42U of the second lateral wedge 42. The groove 42G can include a lip 42M near the upper surface 42 and optionally adjacent the side surface 42S. This lip 42M can capture an end or portion of the elastomeric ring or other tension element 47. Although not shown, the lip 42M can be substituted with simple pins or projections extending from the upper surfaces of the lateral wedges 41 and 42, as well as lower surfaces of those lateral wedges. The elastomeric elements or other tension elements can be wrapped around those pins and can function in this alternative configuration or the configuration shown in the figures to exert forces upon the first and second lateral edges to draw, urge or pull them toward one another or generally toward the longitudinal axis and/or the fastener. With these biasing elements, the wedges can be secured in place adjacent the base block 30 as well as the locking block 50.

As mentioned above, the wedge mechanism 40 and the respective first 41 and second 42 lateral wedges can interact with the locking block 50. The locking block 50 can include a central hole or aperture 50H through which a threaded portion of the fastener 60 can extend. Optionally, the hole 50H can include an insert 50I which is constructed from a harder material than the surrounding material around the hole 50H. As example, the insert 50I can be constructed from a hard metal, such as steel or iron, while the remainder of the locking block 50 can be constructed from aluminum, composite and/or polymer. With this harder insert, it can better interface with the threads of the fastener 60, particularly where the fastener is constructed from steel or iron, without stripping out the locking block. The insert 50I can be press fit, glued, cemented or otherwise fastened and secured to the locking block.

The locking block 50 can include as mentioned above a plurality of facets that mate with and frictionally and/or slidably engage corresponding facets of the first ladder wedge 41 and second lateral wedge 42. For example, the locking block 50 can include facets 54 and 55, shown in FIG. 3, which interface with the facets of the first of the second lateral wedge 42. The locking block 50 can include opposing facets 56 and 57 on the opposite side of the longitudinal axis slidably engage the corresponding facets of the first lateral wedge 41. These respective facets on the respective sides of the longitudinal axis also can be disposed at an oblique dihedral angle relative to one another. The upper and lower facets can transition to respective upper 50U and lower 50L surfaces of the locking block 50. The facets on opposite sides of the locking block 50 can taper inward toward longitudinal axis LA nearing the end that is placed adjacent the base block 30. With these tapered angles, the facets can operate to cleanly and consistently push the first 41 and second 42 lateral wedges outward, away from one another and/or the longitudinal axis or fastener, depending on the application.

Further optionally, the facets on the respective sides of the longitudinal axis can form respective wedge ridges that slidably engage the respective first lateral wedge and second lateral wedge. For example, the first 54 and second 55 facets or surfaces can form a first wedge ridge 54R that can slidably engage the first 44 and second 45 facets of the second lateral wedge 42 is shown in FIG. 6. On the opposing side, the facets 56 and 57 can form a second wedge ridge 56R that can slidably engage the first 56 and second 57 facets or surfaces on the first lateral wedge 41. Again these ridges and the respective facets can slide relative to one another and can form a wedging structure between the locking block 50 and the respective wedges 41, 42, which can expand the wedges outward, away from longitudinal axis and one another. Of course, as the lateral wedges are expanded away from one another with a locking block 50, the biasing elements 47 and 48 urge the first and second lateral wedges toward longitudinal axis and hold them generally in the recess 36 defined by the base block 30.

As mentioned above, the locking block 50 can include the insert 50I defined therein and disposed in a hole 50H. With reference to FIG. 5, the insert and hole are better illustrated. There, the locking block 50 also can include a spring recess 50S. The spring recess 50S can circumferentiate the longitudinal axis LA when the locking block 50 is moved relative to the wedges. The spring recess 50S can capture a portion of a second biasing element 70 that is interposed between the base block 30, in particular the forward engagement wall 35, and the locking block 50. This coil spring can be trapped in the spring recess 50S adjacent and in contact with the locking block 50. This second biasing element 70 can be in the form of a steel spring that is coiled around the faster between the first threaded insert 32I and the second threaded insert 50I and/or the spring recess 50S. This second biasing element 70 can bias the locking block 50 away from the base block 30. This biasing element 70 can be configured to compress when the fastener 60 is rotated and thereby pulls the locking block 50 toward the base block and spreads the first and second lateral wedges outward away from the longitudinal axis and generally from one another. The second bias element 70 also can extend between the first 41 and second 42 lateral wedges rearward of the locking block 50.

Optionally, the bias element 70 can urge the locking block 50 away from the base block 30 at all times. When the fastener 60 is tightened in to draw the locking block 50 toward the base block 30, the bias element 70 is compressed. Simultaneously, the wedges 41 and 42 expand outward away from one another away from longitudinal axis to an extended mode. The first bias elements 47 and 48, however, simultaneously can act on the first and second lateral wedges to urge them toward the longitudinal axis so that they remain in contact with the facets of the locking block 50. When the screw is loosened, the second bias element 70 pushes outward on the locking block 50 so that is urged away from the base block 30. As it moves away from the base block, the first and second lateral wedges 41 and 42 retract toward another, being urged in that direction and toward the longitudinal axis via the first biasing elements 47 and 48.

A method of using the stock mount assembly 10 to mount a stock 11 to a weapon is also provided. In general, the stock mount assembly can be included in and/or joined with the remainder of the stock 11 as shown in FIG. 1. The method generally can include rotating the fastener 60 relative to the base block 30 and locking block 50 disposed between and engaging the first lateral wedge 41 and second lateral wedge 42. These wedges are oppositely disposed from one another on a first side L and a second side R of a longitudinal axis LA. The method can include displacing the locking block 50 relative to the base block 30 to transversely extend the first lateral wedge in the second lateral wedges away from the longitudinal axis LA and away from one another. In turn, the first lateral wedge and the second lateral wedge 41, 42 can engage the first 94 and second 95 side surfaces of the cavity 93 within which the stock mount assembly 10 is at least partially placed. As a result, the wedging action caused by the locking blocks and the respective first and second lateral wedges can forcibly engage the receiver to secure the stock 11 to the firearm 90 with the assembly 10.

As mentioned above, the base block 30, wedge assembly 40, locking block 50 and fastener 60 can be partially inserted into the cavity 93, generally between the side surfaces 94, 95 of the receiver or frame of the firearm or weapon 90. This can be done when the first and second lateral edges wedges 41 and 42 are in the retracted mode shown in FIG. 4. There, the distance D3 of the sidewalls of the respective wedges is not extended too far past the sidewall 32 of the base block 30. With the components installed in the cavity 30, a user can engage the tool S with the head 60H of the fastener 60. The tool S can be rotated so the fastener 60 rotates relative to the recess 32, the insert 32I and the insert 50I of the locking block 50. As a result, the fastener threads into the insert 50I. Due to its connection to the locking block 50, the locking block is urged in the direction L1 shown in FIGS. 6-7. In so doing, the locking block moves linearly generally parallel to the longitudinal axis. As a result, the respective facets of the first lateral wedge and second lateral wedge slide relative to the facets and/or wedge ridges of the locking block 50 as described above. The biasing element 70 is compressed and the biasing elements 47 and 48 are placed under tension as the locking block 50 spreads and moves the first and second lateral wedges 41 and 42 away from one another in directions N1 and N2. These directions N1 and N2 can be transverse to and/or perpendicular relative to the direction L1, and relative to the longitudinal axis LA. The first and second wedges can move simultaneously with one another in opposite directions N1 and N2 as the locking block 50 moves in direction L1.

The fastener 60 can continue to be tightened, moving the locking block 50 in direction L1 and spreading the first wedge 41 and second wedge 42 outward away from one another. As this occurs, the side surface 42S moves outward a distance D3 relative to the side surface 32 of the base block 30. As a result, the side surfaces and the wedges in general begin to exert lateral forces RF and LF outward against the side surfaces of the receiver that are adjacent the cavity 93. This continues until the user determines that the clamping force is sufficient to securely and firmly hold the stock 11 in a static, fixed position secured to the receiver. After the stock mount assembly 10 is satisfactorily installed, the user can remove the tool and confirm that the stock is adequately mounted to the firearm.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to," another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A stock mount assembly that mounts a stock to a firearm, the assembly comprising;

a base including an adapter configured to secure to a stock that protrudes rearward from the firearm;

a base block defining an aperture and including a longitudinal axis separating a first side and an opposing second side;

a first lateral wedge disposed on the first side of the longitudinal axis;

a second lateral wedge disposed on the second side of the longitudinal axis;

a locking block disposed between and engaging the first lateral wedge and the second lateral wedge on the first side and the second side;

a fastener aligned with the longitudinal axis and operably engaging the locking block, the fastener extending through the aperture defined by the base block, wherein rotation of the fastener displaces the locking block relative to the base block to transversely extend the first lateral wedge and the second lateral wedge away from the longitudinal axis and away from one another to forcibly engage first and second side surfaces of a cavity within the firearm to secure the stock to the firearm with the assembly.

2. The assembly of claim 1, wherein the first lateral wedge and the second lateral wedge are biased toward the longitudinal axis with a first biasing element.

3. The assembly of claim 2, wherein the locking block is biased away from the base block with a second bias element separate from the first bias element.

4. The assembly of claim 3, wherein the first bias element is an elastomeric ring that extends between the first lateral wedge and the second lateral wedge.

5. The assembly of claim 4, wherein the second bias element is a coil spring aligned with the longitudinal axis and surrounding the fastener.

6. The assembly of claim 1, wherein the locking block is biased away from the base block with a bias element in the form of a coil spring.

7. The assembly of claim 1, wherein the first lateral wedge includes a first facet and a second facet disposed at an oblique dihedral first angle relative to one another, wherein the second lateral wedge includes a first facet and a second facet disposed at an oblique dihedral second angle relative to one another.

8. The assembly of claim 7, wherein the first angle and the second angle are equal.

9. The assembly of claim 8, wherein the locking block includes a first wedge ridge that is configured to slidably engage the first facet and the second facet of the first lateral wedge, wherein the locking block includes a second wedge ridge that is configured to slidably engage the first facet and the second facet of the second lateral wedge.

10. The assembly of claim 1 comprising:

a first threaded insert joined with the locking block and configured to engage the fasteners; and a second threaded insert joined with the base block and configured to engage the fastener distal from the first threaded insert.

11. The assembly of claim 10, comprising:

a spring coiled around the fastener between the first threaded insert and the second threaded insert.

12. The assembly of claim 1, comprising:

an elastomeric ring extending around the first lateral wedge and the second lateral wedge and configured to urge the first lateral wedge and the second lateral wedge toward one another.

13. A stock mount assembly that mounts a stock to a firearm, the assembly comprising;

a base block including a longitudinal axis separating a first side and an opposing second side;

a first lateral wedge opposing a second lateral wedge;

a locking block slidably engaging the first lateral wedge and the second lateral wedge at a plurality of facets angled relative to one another;

a fastener aligned with the longitudinal axis and extending through the base block, wherein rotation of the fastener displaces the locking block relative to the base block to urge the first lateral wedge and the second lateral wedge away from one another and radially outward from the longitudinal axis in different directions to forcibly engage first and second side surfaces of a cavity within the firearm to secure a stock to the firearm with the assembly.

14. The assembly of claim 13 comprising:

an upper bias element engaging an upper portion of the first lateral wedge and an upper portion of the second lateral wedge, the upper bias element extending transverse to the longitudinal axis form the first side to the second side;

a lower bias element engaging a lower portion of the first lateral wedge and a lower portion of the second lateral wedge, the lower bias element extending transverse to the longitudinal axis form the first side to the second side.

15. The assembly of claim 14, wherein the upper portion of the first lateral wedge defines a first groove, wherein the upper portion of the second lateral wedge defines a second groove.

16. The assembly of claim 13, wherein the locking block is linearly urged along the longitudinal axis away from the base block with a coil spring.

17. The assembly of claim 13, wherein the first lateral wedge and the second lateral wedge are biased toward the longitudinal axis with a first biasing element, wherein the locking block is biased away from the base block with a second bias element separate from the first bias element, wherein the locking block includes a multi-facet engagement end that faces toward the locking block, the multi-facet engagement end slidably engaging the plurality of facets of the first lateral wedge and the second lateral wedge, wherein the multi-facet engagement end includes a first wedge ridge and a second wedge ridge disposed on the locking block on the first side and the second side.

18. A method of using a stock mount assembly to mount a stock to a firearm, the method comprising;

rotating a fastener relative to base block and a locking block disposed between and engaging a first lateral wedge and a second lateral wedge oppositely disposed from one another on a first side and a second side of a longitudinal axis; and displacing the locking block relative to the base block to transversely extend the first lateral wedge and the second lateral wedge away from the longitudinal axis and away from one another to forcibly engage first and second side surfaces of a cavity within a firearm to secure the stock to the firearm with the assembly.

19. The method of claim 18, comprising:

sliding a first facet of the first lateral wedge relative to a first facet of the locking block;

sliding a second facet of the second lateral wedge relative to a second facet of the locking block;

sliding a third facet of the first lateral wedge relative to a third facet of the locking block;

sliding a fourth facet of the second lateral wedge relative to a fourth facet of the locking block.

20. The method of claim 18 comprising:

urging the first lateral wedge toward the second lateral wedge with elastomeric biasing elements joined with upper and lower parts of the first and second lateral wedges as the locking block separates the first lateral wedge from the second lateral wedge.

* * * * *